US007967020B2

(12) United States Patent
Jimenez

(10) Patent No.: US 7,967,020 B2
(45) Date of Patent: Jun. 28, 2011

(54) HAND HELD SELF CONTAINED PACIFIER OR BABY BOTTLE NIPPLE SPRAY CLEANER

(76) Inventor: Matthew Jimenez, El Monte (CA)

( * ) Notice: Subject to any disclaimer, the term of this patent is extended or adjusted under 35 U.S.C. 154(b) by 510 days.

(21) Appl. No.: 12/058,410

(22) Filed: Mar. 28, 2008

(65) Prior Publication Data

US 2009/0242000 A1 Oct. 1, 2009

(51) Int. Cl.
*B08B 3/00* (2006.01)
*B08B 3/12* (2006.01)
*B08B 6/00* (2006.01)

(52) U.S. Cl. ..... 134/135; 134/109; 134/110; 134/111; 134/184; 134/195; 134/196; 134/197; 134/198; 134/199; 134/200; 134/201

(58) Field of Classification Search ..... 134/135, 134/109–111, 184, 195–201
See application file for complete search history.

(56) References Cited

U.S. PATENT DOCUMENTS 4,054,220 A * 10/1977 Rosenstein ..... 215/6
5,000,209 A * 3/1991 Mann ..... 134/135
5,402,810 A * 4/1995 Donley ..... 134/135
D358,243 S 5/1995 Ferguson
6,343,612 B1 2/2002 Dahl
6,708,363 B2 * 3/2004 Larsen ..... 15/104.92
7,207,342 B1 * 4/2007 Daniels ..... 134/111
2004/0258560 A1 * 12/2004 Lake et al. ..... 422/28
2007/0012248 A1 * 1/2007 Aucoin ..... 118/270

FOREIGN PATENT DOCUMENTS

ZA 9808723 A * 6/1999

OTHER PUBLICATIONS

ZA 9808723 Derwent Abstract.*

* cited by examiner

*Primary Examiner* — Michael Barr
*Assistant Examiner* — Charles W Kling
(74) *Attorney, Agent, or Firm* — Kenneth L. Green

(57) ABSTRACT

A hand held self contained cleaning apparatus includes a reservoir containing a single use cleaning and/or disinfecting liquid, a pump, and a nozzle for directing a spray of the cleaning and/or disinfecting liquid against a soiled nipple of a pacifier or baby bottle cap. The apparatus includes a platform for supporting the pacifier or bottle cap, a mouth for inserting the nipple into an area just above the nozzle, and a separator for preventing dirty liquid from returning to the reservoir. The spray is directed against a soiled nipple to loosen and remove soil from the nipple. After cleaning the pacifier or bottle cap, the dirty cleaning liquid is released so new clean liquid may be used for the next cleaning. The apparatus may be carried with other related items and used to clean the pacifier or bottle cap at any location and in particular away from home.

12 Claims, 3 Drawing Sheets

HAND HELD SELF CONTAINED PACIFIER OR BABY BOTTLE NIPPLE SPRAY CLEANER

BACKGROUND OF THE INVENTION

The present invention relates to apparatus and methods for cleaning small objects and in particular to apparatus and methods for cleaning baby pacifiers and baby bottle nipples.

Parents and care givers commonly use pacifiers to comfort and quiet infants and provide nourishment from baby bottles through nipples attached to the baby bottles. Unfortunately, infants often play with their pacifiers and either rub the pacifier against soiled and unsanitary surfaces or drop the pacifier on the floor. Similarly, baby bottles are subject to contact with soiled and unsanitary surfaces or an infant may handle the nipple with dirty hands or the bottle may be dropped onto the floor. Parents and care givers are also often required to care for an infant away from home and often do not have a convenient way to clean soiled pacifiers and nipples.

U.S. Pat. No. 6,343,612 for "Portable Pacifier Cleaner and Container," discloses a two compartment apparatus having a dry first compartment for storing a pacifier and a second compartment containing a liquid for cleaning the pacifier should it become soiled. Unfortunately, the apparatus of the '612 patent requires reuse of a dirty liquid which may contaminate the pacifier.

U.S. Pat. No. 5,402,810 for "Pacifier Storage and Washing Apparatus and Method," discloses apparatus with liquid in the bottom portion and a shelf with openings to allow the liquid to enter a top portion holding a pacifier. Motion of the apparatus allows the liquid to enter the top portion to clean the pacifier. Unfortunately, the apparatus of the '810 patent also reuses dirty and/or contaminated liquid and may thereby contaminate the pacifier.

BRIEF SUMMARY OF THE INVENTION

The present invention addresses the above and other needs by providing a hand held self contained cleaning apparatus which includes a reservoir containing a single use cleaning and/or disinfecting liquid, a pump, and a nozzle for directing a spray of the cleaning and/or disinfecting liquid against a soiled nipple of a pacifier or baby bottle cap. The apparatus includes a platform for supporting the pacifier or bottle cap, a mouth for inserting the nipple into an area just above the nozzle, and a separator for preventing dirty liquid from returning to the reservoir. The spray is directed against a soiled nipple to loosen and remove soil from the nipple. After cleaning the pacifier or bottle cap, the dirty cleaning liquid is released so new clean liquid may be used for the next cleaning. The apparatus may be carried with other related items and used to clean the pacifier or bottle cap at any location and in particular away from home.

In accordance with one aspect of the invention, there is provided a self contained hand held nipple cleaning apparatus. The cleaning apparatus includes a housing, an upper portion of the housing for containing the nipple, and a nozzle connected to a pump residing inside the housing for providing a spray of cleaning liquid into the upper portion of the housing and towards the nipple. A horizontal landing above the upper portion supports a nipple flange and a mouth in the horizontal landing allows the nipple to extend downward through the horizontal landing into the upper portion of the housing. A short wall surrounds the horizontal landing and has a shape of an outline of the nipple flange. A reservoir in a base of the housing holds the cleaning liquid and a pump plunger extending from the pump horizontally through the housing allows operation of the pump. A suction tube is connected to an inlet of the pump and has a suction end in the reservoir for providing cleaning liquid to the pump.

In accordance with another aspect of the invention, there is provided a method for cleaning a pacifier. The method includes filling a reservoir portion of a pacifier cleaning apparatus with a cleaning liquid, positioning a pacifier into the cleaning apparatus with a pacifier nipple inserted through a mouth into an upper portion of the apparatus, pumping the cleaning liquid from the reservoir portion into the upper portion to clean the nipple, removing the cleaned pacifier from the cleaning apparatus, and disposing of the used cleaning liquid to allow subsequent use of fresh cleaning liquid.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
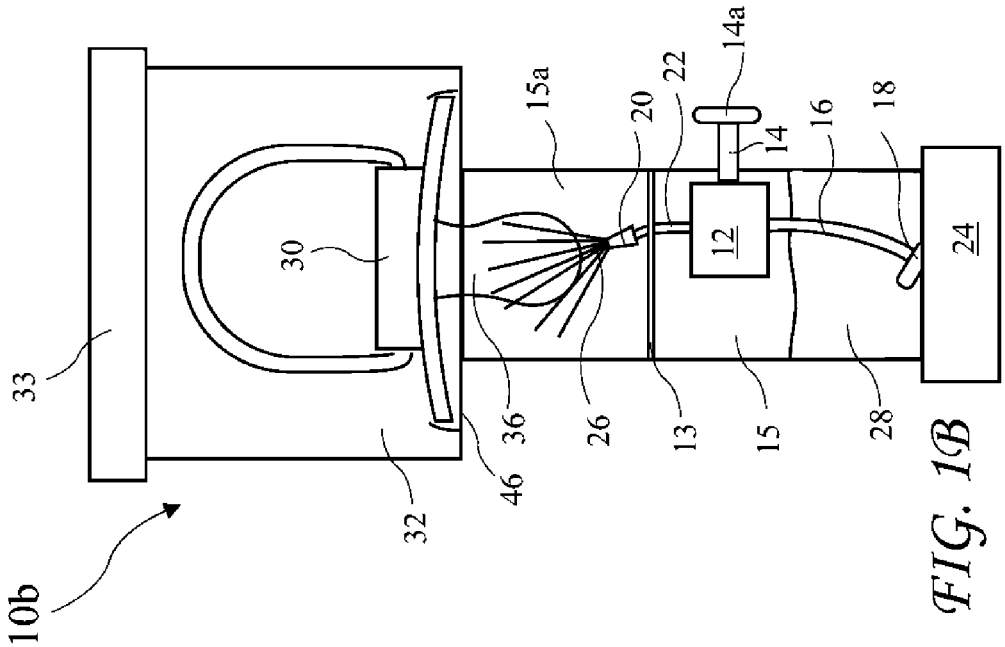
FIG. 1B is a second hand held self contained spray apparatus including a chamber according to the present invention containing the pacifier.
Figure 1A:
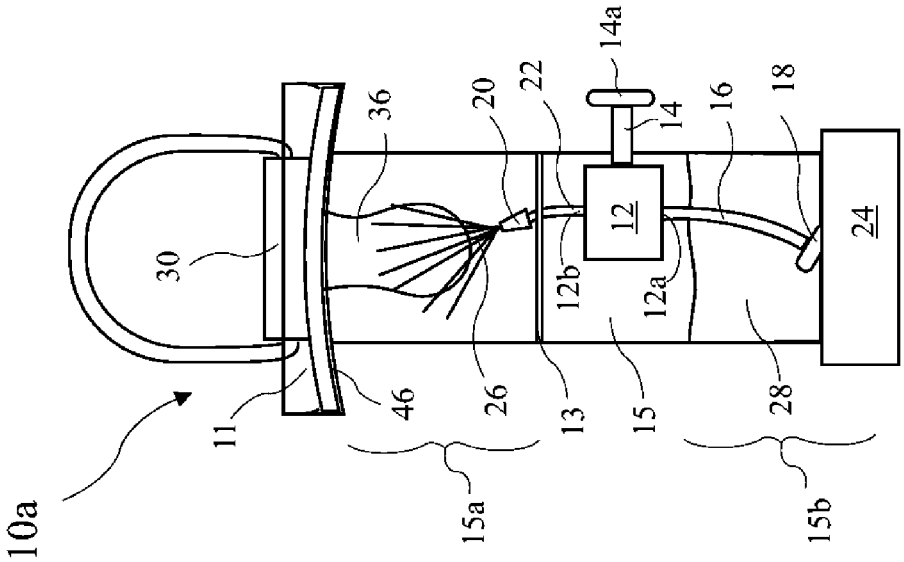
FIG. 1A is a first hand held self contained spray apparatus according to the present invention and a pacifier.

A first hand held self contained spray apparatus 10*a* according to the present invention is shown cleaning a nipple 36 of a pacifier 30 in FIG. 1A. The hand held self contained spray apparatus 10*a* includes a housing 15 containing a cleaning liquid 28 and a pump 12. The pump 12 receives the cleaning liquid 28 held in a reservoir portion 15*b* in a base of the housing 15 through a pickup 18 and suction tube 16 connected to a pump inlet 12*a* and provides a spray 26 of the cleaning liquid 28 through a nozzle 20 connected to a pump outlet 12*b* by a pressure tube 22 into an upper portion 15*a* of the housing 15. The nipple 36 of the pacifier 30 extends downward through a mouth 44 in a horizontal landing 46 of a platform 11 into the upper portion 15*a* and a nipple flange 34 of the nipple rests on the horizontal landing 46 (also see FIGS. 2-5). The nipple 36 is thereby positioned in the spray 26. A single nozzle 20 is preferably solely attached to a single pressure tube 22 and preferably provides a spray 26 pattern across the nipple 36.

A plunger 14 for operating the pump 12 is attached to the pump 12 and extends horizontally through the side of the housing 15 and includes a vertical finger surface 14*a* for pressing to operate the pump 12. A removable cap 24 seals the base of the housing 15 and may be opened to add the cleaning liquid 28. The cap 24 may be screw-on or snap-on. The cleaning liquid 28 may be water or a disinfectant which is safely consumable by an infant, such as mouth wash or diluted mouth wash.

A second hand held self contained spray apparatus 10*b* including a chamber 32 according to the present invention is shown containing the pacifier 30 in FIG. 1B. The apparatus 10*b* is similar to the apparatus 10*a*, with an exception that the platform 11 is replaced by the chamber 32. The chamber 32 has a chamber cap 33 which may be screw-on or snap-on.

Figure 2:
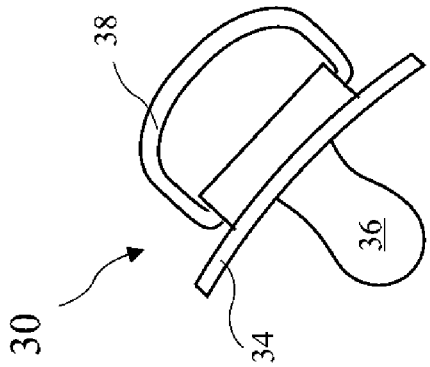
FIG. 2 is a pacifier suitable for cleansing using the present invention.
Figure 3:
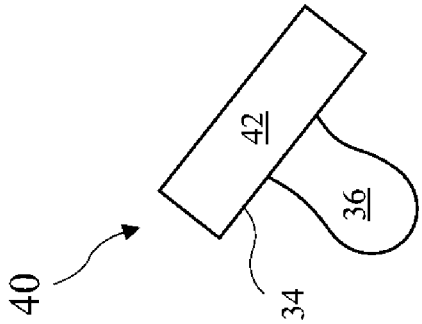
FIG. 3 is a baby bottle cap suitable for cleansing using the present invention.

A pacifier 30 suitable for cleaning using the apparatus 10*a* or 10*b* is shown in FIG. 2 and a baby bottle cap 40 suitable for cleaning using the apparatus 10*a* or 10*b* is shown in FIG. 3. Both the pacifier 30 and the baby bottle cap 40 include the nipple 36 and a nipple flange 34. The pacifier 30 further includes a pacifier ring 38, and the baby bottle cap 40 further includes a screw-on cap portion 42.

Importantly, both the apparatus 10*a* and 10*b* include a solid separator 13 between the reservoir portion 15*b* and the upper portion 15*a* preventing used liquid 28 from returning to the reservoir portion 15*b* after becoming dirty or contaminated. As a result, the failure of known apparatus to prevent contamination by dirty liquid 28 is avoided.

While both apparatus 10*a* and 10*b* are shown with the spray nozzle 20, an embodiment of the present invention without a spray nozzle may be used as long as means are provided to pump the liquid 28 into the upper portion 15*a* for single use cleaning. For example, pumping may be provided by a squeezable reservoir portion, a feed tube extending to the bottom of the squeezable reservoir portion, and a one way valve between the reservoir portion and the upper portion to obtain a single use of the cleaning liquid 28. In another example, the apparatus may include the pump 12 used simply to pump cleaning liquid 28 into the upper portion 15*a*.

Figure 5:
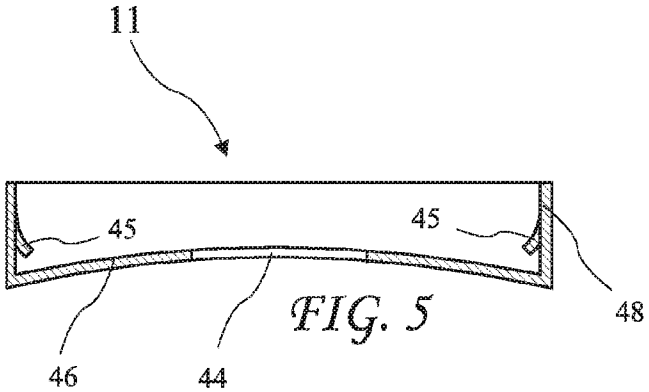
FIG. 5 is a cross-sectional view of the platform taken along line 5-5 of FIG. 4.
Figure 4:
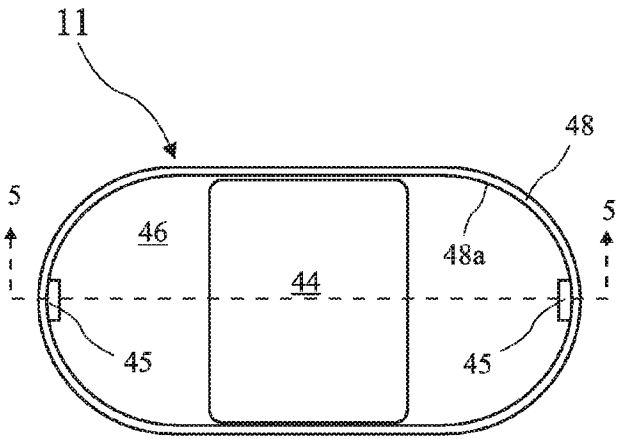
FIG. 4 is a top view of a platform according to the present invention for holding a pacifier during cleaning.

A top view of a platform 11 according to the present invention for holding a pacifier 30 during cleaning is shown in FIG. 4 and a cross-sectional view of the platform 11 taken along line 5-5 of FIG. 4 is shown in FIG. 5. The platform 11 includes the horizontal landing 46 for supporting the pacifier 30, and a short wall 48 surrounding the horizontal landing 46. The wall 48 has an inside face 48*a* creating an outline slightly greater than the outline of the nipple flange 34 of the pacifier 30. The nipple flange of the baby bottle cap 40 is generally round, and the inside face 48*a* of a platform wall 48 intended for use with the baby bottle cap 40 would generally also be round. The platform 11 further includes the mouth 44 which may be rectangular or round and is provided to allow the nipple 36 to pass through the horizontal landing 46 into upper portion 15*a* of the apparatus 10*a* and 10*b* (see FIG. 1A and FIG. 1B). Tabs 45 extend inwardly from the wall 48 and provide positive retention of the nipple flange 34 in the platform 11.

While the platform 11 is shown having an oval outline suitable for a pacifier, a platform may also be round to accept the baby bottle cap 40. The platform and wall 48 may further be sized for a particular pacifier nipple flange 34 size and/or shape, and the tabs 45 may be sized and positioned on the wall 48 for a particular pacifier nipple flange 34 size and/or shape.

Figure 6:
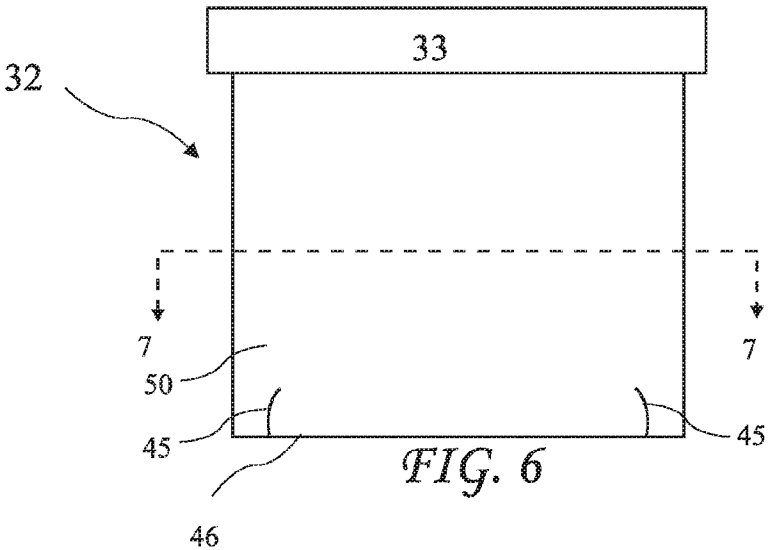
FIG. 6 is a side view of a container according to the present invention for containing the pacifier or a baby bottle cap.
Figure 7:
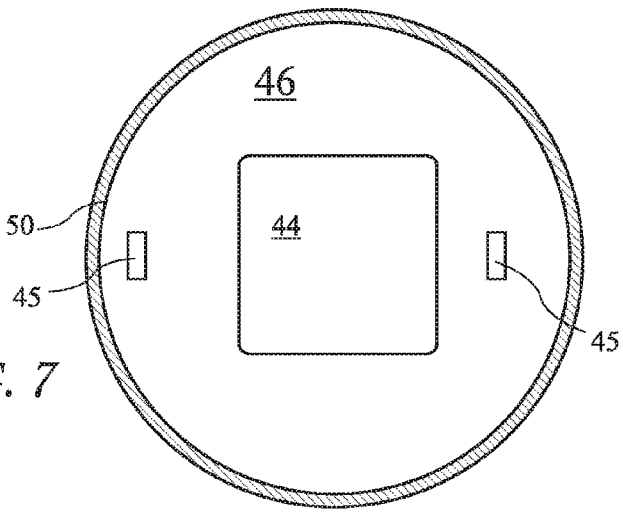
FIG. 7 is a cross-sectional view of the container taken along line 7-7 of FIG. 6.

A side view of the chamber 32 according to the present invention for containing the pacifier 30 or the baby bottle cap 40 is shown in FIG. 6 and a cross-sectional view of the chamber 32 taken along line 7-7 of FIG. 6 is shown in FIG. 7. The chamber 32 includes a container wall 50 and a container cap 33. The container cap 33 may be screw-on or snap-on. The chamber 32 is generally cylindrical in shape. The chamber 32 may include tabs 45 to hold the pacifier 30 in position for cleaning.

The apparatuses 10*a* and 10*b* are preferably made from plastic.

Figure 8:
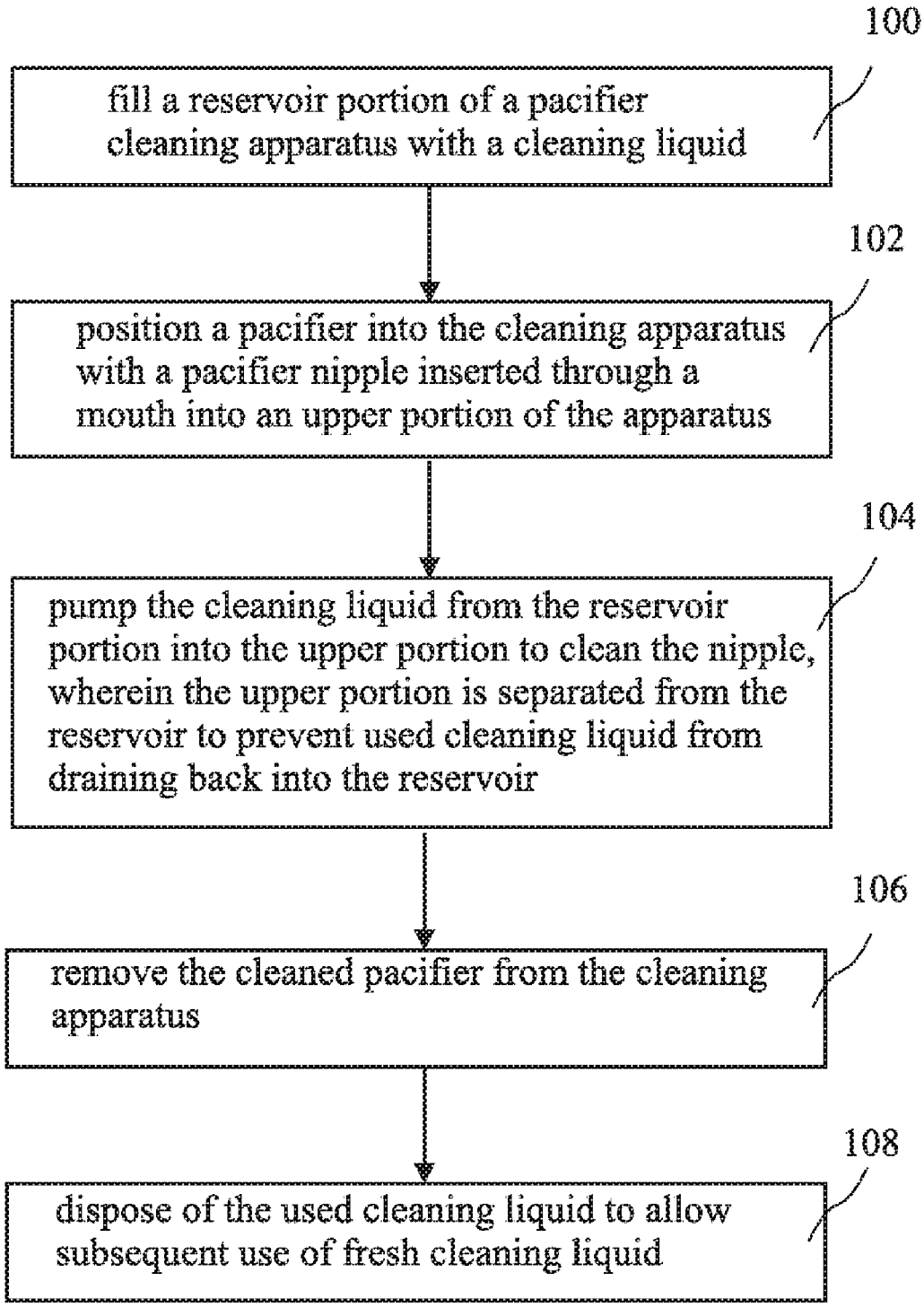
FIG. 8 describes a method for cleaning a pacifier according to the present invention.

A method according to the present invention for cleaning a pacifier is described in FIG. 8. The method includes filling a reservoir portion of a pacifier cleaning apparatus with a cleaning liquid at step 100, positioning a pacifier into the cleaning apparatus with a pacifier nipple inserted through a mouth into an upper portion of the apparatus at step 102, pumping the cleaning liquid from the reservoir portion into the upper portion to clean the nipple, wherein the upper portion is separated from the reservoir to prevent used cleaning liquid from draining back into the reservoir, at step 104, removing the cleaned pacifier from the cleaning apparatus at step 106, and disposing of the used cleaning liquid to allow subsequent use of fresh cleaning liquid at step 108. Positioning a pacifier into the cleaning apparatus may comprise snapping the pacifier under tabs on a wall around a horizontal landing to retain the pacifier in the apparatus.

While the invention herein disclosed has been described by means of specific embodiments and applications thereof, numerous modifications and variations could be made thereto by those skilled in the art without departing from the scope of the invention set forth in the claims.

I claim:

1. A self contained hand held baby bottle cap nipple and pacifier nipple cleaner comprising:

a housing;

an upper portion of the housing for containing the nipple;

a reservoir for holding cleaning liquid in a base of the housing;

a horizontal separator between the reservoir and the upper portion preventing used cleaning liquid from returning to the reservoir;

a pump residing inside the housing;

a pump plunger extending from the pump horizontally through the housing for operating the pump;

a suction tube connected to a pump inlet and having a suction end in the reservoir for providing cleaning liquid to the pump;

a pressure tube attached to a pump outlet in fluid communication with cleaning liquid under pressure in the pump, the pressure tube reaching upwards through the horizontal separator into the upper portion;

a nozzle connected to the pressure tube for receiving the pressurized cleaning liquid from the pump and providing a spray of the cleaning liquid directed upwards into the upper portion of the housing and towards the nipple;

a horizontal landing resides above the upper portion for supporting a nipple flange of the nipple and a window in the horizontal landing allows the nipple to enter the upper portion; and a short wall residing around the horizontal landing having a shape of an outline of a baby bottle cap, the short wall forming an upward open concave region for accepting the baby bottle cap inserted downward there into.

2. The nipple cleaner of claim 1, wherein a chamber resides above the horizontal landing for holding either of the baby bottle cap and the pacifier.

3. The nipple cleaner of claim 2, wherein a lid resides over a top of the chamber.

4. The nipple cleaner of claim 1, wherein the cleaning liquid comprises water.

5. The nipple cleaner of claim 1, wherein the cleaning liquid comprises a liquid selected from the set consisting of mouth wash and diluted mouth wash.

6. The nipple cleaner of claim 1, wherein a single nozzle is solely connected to a single pressure tube.

7. The nipple cleaner of claim 6, wherein the single nozzle provides a spray pattern directed upwards against the nipple.

8. A self contained hand held baby bottle cap nipple and pacifier nipple cleaner comprising:

a housing;

an upper portion of the housing for containing the nipple;

a reservoir for holding cleaning liquid in a base of the housing;

a horizontal separator between the reservoir and the upper portion preventing used cleaning liquid from returning to the reservoir;

a pump residing inside the housing;

a pump plunger extending from the pump horizontally through the housing for operating the pump;

a suction tube connected to a pump inlet and having a suction end in the reservoir for providing cleaning liquid to the pump;

a pressure tube attached to a pump outlet in fluid communication with cleaning liquid under pressure in the pump, the pressure tube reaching upwards through the horizontal separator into the upper portion;

a nozzle connected to the pressure tube for receiving the pressurized cleaning liquid from the pump and providing a spray of the cleaning liquid directed upwards into the upper portion of the housing and towards the nipple;

a horizontal landing resides above the upper portion for supporting a nipple flange of the nipple and a window in the horizontal landing allows the nipple to enter the upper portion; and a short wall residing around the horizontal landing having a shape of an outline of the nipple flange, the short wall forming an upward open concave region for accepting the nipple flange inserted downward there into.

9. The nipple cleaner of claim 8, wherein two tabs are formed in opposite sides of the short wall, the tabs projecting inward and downward and leaving a gap between a bottom end of each tab and the horizontal landing, the gap slightly greater than a thickness of the nipple flange, the tabs for holding the nipple in position for cleaning.

10. A hand held pacifier nipple cleaner comprising:

a housing;

an upper portion of the housing for containing the nipple;

a horizontal landing above the upper portion for supporting a nipple flange of the pacifier, a mouth in the horizontal landing for allowing the nipple to extend downward through the horizontal landing into the upper portion of the housing;

a short wall residing around the horizontal landing having a shape of an outline of the nipple flange, the short wall forming an upward open concave region for accepting the nipple flange inserted downward there into;

a reservoir for holding cleaning liquid in a base of the housing;

a horizontal separator between the reservoir and the upper portion preventing used cleaning liquid from returning to the reservoir;

a pump residing inside the housing;

a pump plunger extending from the pump horizontally through the housing, the plunger for operating the pump;

a suction tube connected to an inlet of the pump and having a suction end in the reservoir for providing cleaning liquid to the pump;

a pressure tube attached to a pump outlet in fluid communication with cleaning liquid under pressure in the pump, the pressure tube reaching upwards through the horizontal separator into the upper portion; and a nozzle connected to the pressure tube for receiving the cleaning liquid from the pump and providing an upward spray of the cleaning liquid into the upper portion of the housing and towards the nipple.

11. The hand held pacifier nipple cleaner of claim 10, further including a chamber attached to the housing and residing above the horizontal landing for containing a portion of the pacifier.

12. The nipple cleaner of claim 10, wherein a single nozzle is solely connected to a single pressure tube.

* * * * *